United States Patent [19]

Hampel et al.

[11] Patent Number: 5,018,464

[45] Date of Patent: May 28, 1991

[54] CUTTING DEVICE

[75] Inventors: Klaus Hampel, Bielefeld; Reinhold Schrudde, Oerlinghausen, both of Fed. Rep. of Germany

[73] Assignee: Kochs Adler Aktiengesellschaft, Fed. Rep. of Germany

[21] Appl. No.: 439,709

[22] Filed: Nov. 20, 1989

[30] Foreign Application Priority Data

Nov. 22, 1988 [DE] Fed. Rep. of Germany ..... 3839367

[51] Int. Cl.[5] ..... D05B 37/04

[52] U.S. Cl. ..... 112/130

[58] Field of Search ..... 112/288, 130, 289–299, 112/286, 287, 300, 301, DIG. 3, 261

[56] References Cited

U.S. PATENT DOCUMENTS

| | | | |
|---|---|---|---|
| 1,065,941 | 7/1913 | Holtzmann | 112/130 |
| 2,881,833 | 9/1955 | Hoffee | 112/300 |
| 3,250,237 | 5/1966 | Myska | 112/288 |
| 3,587,499 | 6/1971 | Murdter | 112/288 |
| 3,696,770 | 10/1972 | Dunne et al. | 112/288 |
| 4,281,607 | 8/1981 | Torre | 112/130 |
| 4,438,714 | 3/1984 | Smith et al. | 112/261 |
| 4,607,583 | 8/1986 | Biermann et al. | 112/294 |
| 4,735,160 | 4/1988 | Hampel et al. | 112/288 |
| 4,883,010 | 11/1989 | Matsumoto | 112/288 |

FOREIGN PATENT DOCUMENTS

| | | | |
|---|---|---|---|
| 0000093 | 1/1984 | Japan | 112/130 |

*Primary Examiner*—Werner H. Schroeder
*Assistant Examiner*—Sullivan C. Prak
*Attorney, Agent, or Firm*—Ostrolenk, Faber, Gerb & Soffen

[57] ABSTRACT

A cutting device for an automatic sewing machine, including a knife (2) and a knife guard (3) which projects the fingers of the operator. The knife (2) is capable of being lowered to a cutting area in a cutting plane (S) only when the knife guard (3) is in its protecting position. The knife (2) and knife guard (3) are driven simultaneosuly by a single drive, the knife guard (3) reaching the cutting plane (S) earlier than the knife (2). If the knife guard (3) cannot substantially reach its protective position, then the downward movement of the knife (2) is mechanically blocked, preventing further movement of the knife (2). This mechanical blocking is carried out by the coaction of a lever (20) which is connected to the knife guard (3) by a connecting member (21), the lever (20) being moveable in translation and rotation, and by a lever (19), which is moveable rotationally only and has a stop (37) thereon for blocking movement of the knife (2) when the knife guard (3) is not in its protective position. The stop (37) is responsive both to the drive (5) and to the degree to which the knife guard (3) has been lowered.

11 Claims, 5 Drawing Sheets

CUTTING DEVICE

BACKGROUND OF THE INVENTION

1. Field of the Invention

The present invention relates to a cutting device for a sewing machine, having a cutting area in the vicinity of its sewing area; the cutting device including a knife and a knife guard which is movable into a protective position surrounding the cutting area; common drive means for driving the knife and the knife guard; and mechanical stop means for stopping the knife, and releasing the knife only when the knife guard is substantially in its protective position surrounding the cutting area.

2. Background Art

In one such cutting device, known from U.S. Pat. No. 4,735,160, the knife guard first moves into a position in front of the cutting place so as to protect the fingers of the operator, and then the knife carries out its cutting movement. For this purpose, the knife guard and the knife are coupled to each other by a toggle lever which is connected to a lifting cylinder hen the lifting cylinder moves outward, initially only the knife guard is driven and moved toward the cutting place. When the knife guard has assumed its position in which it protects the fingers of the operator, an interlock for the knife which has been engaged until that time is released, permitting the knife to be driven by the further outward movement of the lifting cylinder and moved to the cutting place. If the knife guard does not assume its protecting position, i.e., is not lowered in front of the cutting place, the interlock prevents the knife from being moved.

This known device is relatively large. It must be arranged as close as possible behind the sewing place, so it can only be used on sewing machines which offer a corresponding amount of space. In order to form the cut cleanly, the knife must be guided during its operation. To permit thicker materials, for instance piping or slide fasteners, to be cut after they are sewn, sufficient space must be available for them to pass between the knife and the cutting place. As a result of this, the knife guides are relatively far away from the cutting place and this causes additional forces to act on them, which makes them technically very costly.

It is furthermore known to use so-called shears as a cutting device. In accordance with the prior art, for reasons of safety, the available passage space in the open position of these shears may be so limited that the operator cannot get his or her fingers below the cutting edge, which has the disadvantage that the thickness of the material that can be worked is also limited. Safety may also be improved by controlling the shears in such a manner that automatic cutting cannot take place, thus requiring the cutting to be initiated by the operator. In the latter case, a two-hand safety operation with a manually adjustable protective device for third parties is provided. This has the disadvantage that the operator must remove both hands from the sewing material while it is being cut, and thus can no longer guide it.

U.S. Pat. No. 4,281,607 discloses a cutting device which is provided with a guard means. In this case the lowered guard actuates an electric switch means which causes the knife drive to be able to receive control signals only when the guard means is in its protecting position. However, if the electrical control device fails, the danger exists that the knife will descend even though the knife guard is not in position.

SUMMARY OF THE INVENTION

In view of the foregoing disadvantages of the prior art, the main object of the present invention is to provide an automatic cutting device with which it is possible to cut thick materials as well as thin materials.

A further object is to provide a cutting device having a knife and a knife guard, with which cutting is possible only if the knife guard is completely or practically completely in its protecting position.

Another object is to provide a cutting device which furthermore requires only a small space for its installation or removal and at the same time is highly reliable and can be manufactured at low cost.

These objects are achieved by a cutting device for a sewing machine, having a cutting area in the vicinity of its sewing area;

the cutting device including a knife and a knife guard which is movable into a protective position surrounding the cutting area; common drive means for driving the knife and the knife guard;

mechanical stop means for stopping the knife, and for releasing the knife only when the knife guard is substantially in its protective position surrounding the cutting area;

wherein the stop means operates automatically during the movement of the knife and the knife guard toward the cutting area, to stop the movement of the knife, if the knife guard is not substantially in its protective position.

According to an advantageous aspect of the invention, the drive means drives the knife and the knife guard simultaneously, and starting from an initial position, the knife and the knife guard are initially driven in opposite directions. The drive means commences the movement of the knife guard and the knife towards the cutting area simultaneously; and the knife guard reaches the cutting area before the knife.

According to certain advantageous aspects of the mechanism, the knife is initially driven by the drive, and the knife guard is simultaneously braked by the drive when their movement toward the cutting plane begins. The knife and the knife guard follow an arcuate path from their initial position, about a pivot point, as they are lowered to the cutting plane, and the maximum angle which the knife can form with the cutting plane is greater than the maximum angle which knife guard can form with the cutting plane.

Preferably, the mechanical stop means comprises two levers, the first lever being attached to and driven by the knife guard, and the second lever being driven by the drive means. The stop means is responsive both to the degree of lowering of the knife guard, and to the drive means which controls the downward movement of the knife. The first and second levers are mounted for rotation about a common shaft; the first lever carries out a combined rotational and translational movement; and the second lever carries out a purely rotational movement. The second lever advantageously has a stop mounted thereon which extends toward the first lever and engages against the first lever so as to prevent further movement of the knife, when the knife guard is not substantially completely lowered.

A translational movement of the first lever removes the stop on the second lever from engagement with the first lever when the knife guard is substantially completely in its protecting position.

In the cutting device of the invention, only a single, externally actuated mechanical drive means is used to control both the knife and the knife guard. Furthermore, the stop means which prevents the lowering of the knife is controlled mechanically by the knife guard, thereby preventing injuries caused by the knife guard as well as injuries caused by the knife itself.

Other objects, features, and advantages of the invention will be explained in further detail in connection with a non-limiting example, with reference to the drawings.

DETAILED DESCRIPTION OF THE EMBODIMENT

Structure

Figure 1:
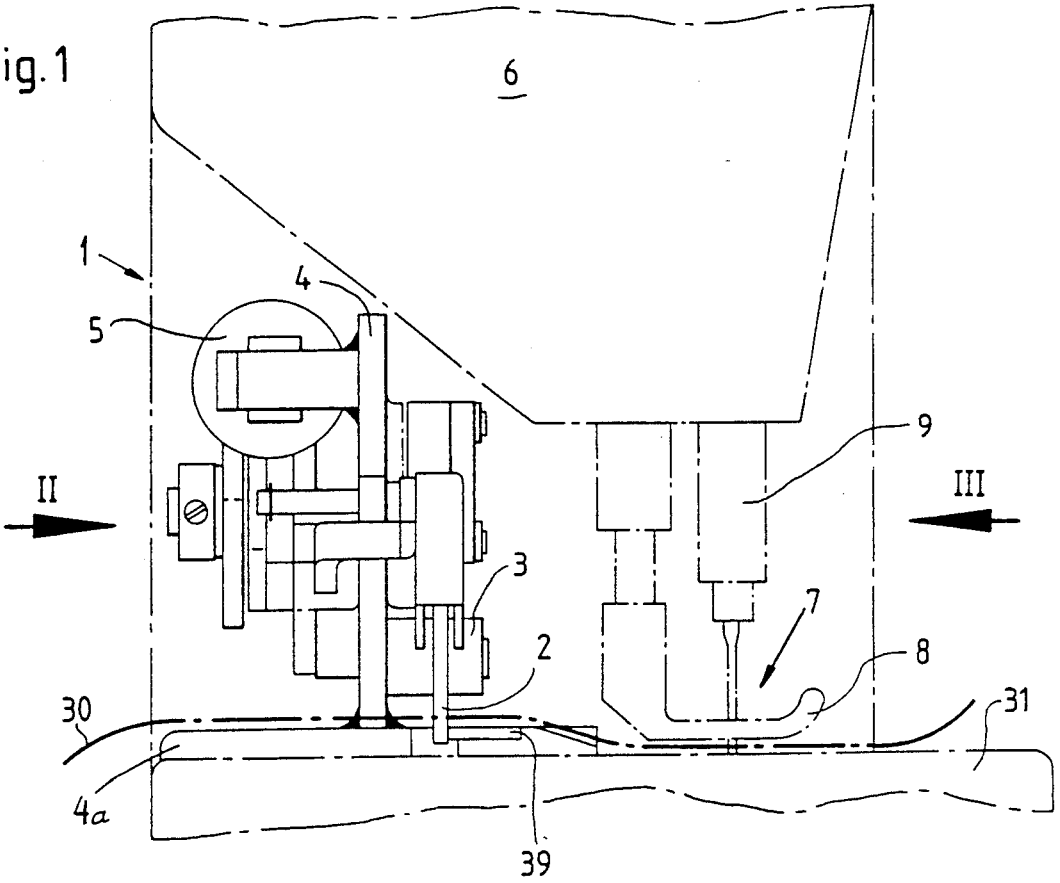
FIG. 1 is a side view showing a cutting device according to an embodiment of the invention, installed on a sewing machine.

FIGS. 1–4 show a cutting device 1 in its installed position "behind" the sewing area 7 of an automatic sewing machine, that is, downstream in the direction of travel of the sewing material 30, the travel direction being from right to left in FIG. 1. The cutting device 1 comprises a knife 2, a knife guard 3, a double-acting pneumatic cylinder 5 which serves as a drive, and a support 4 which receives the individual structural parts.

Figure 2:
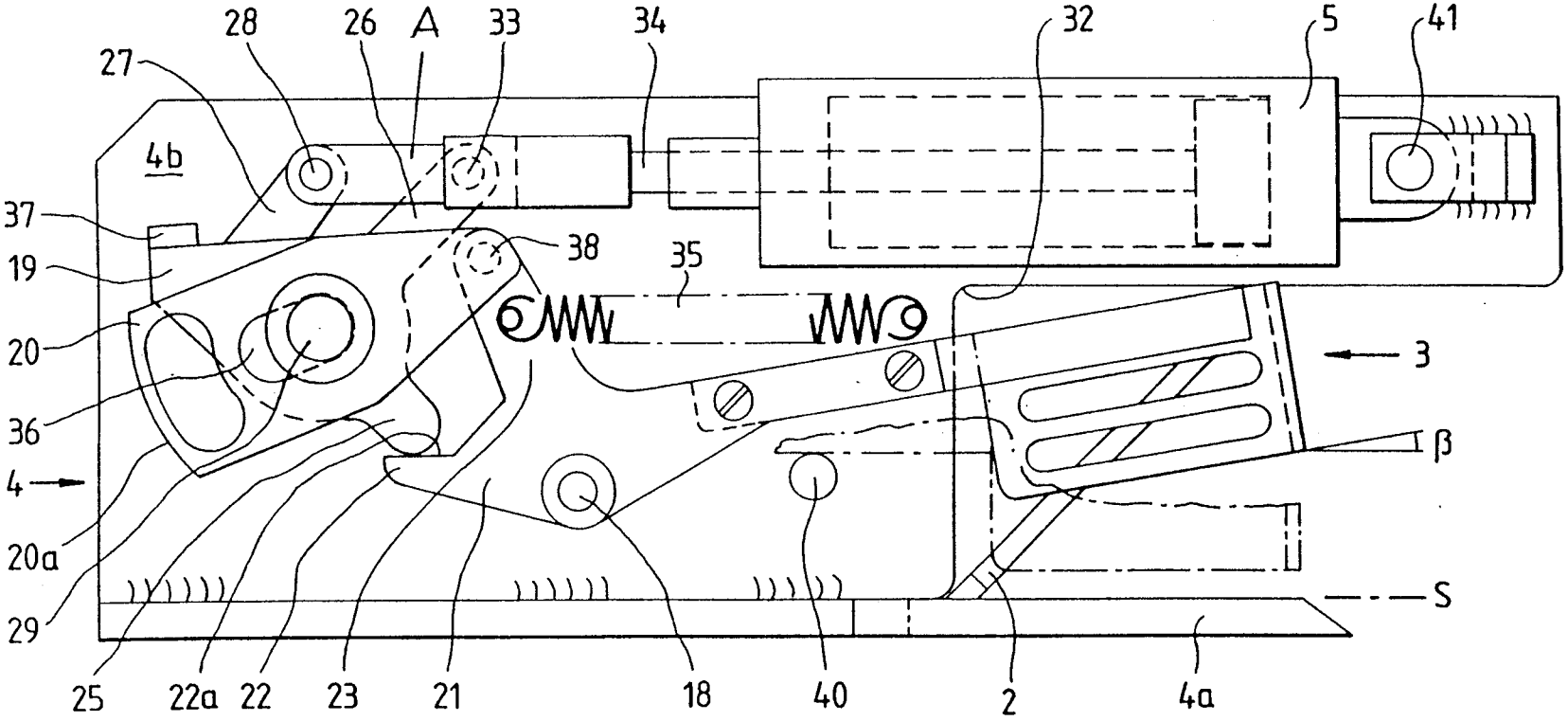
FIG. 2 is a side view of the cutting device, as seen in the direction of arrow II in FIG. 1.
Figure 2A:
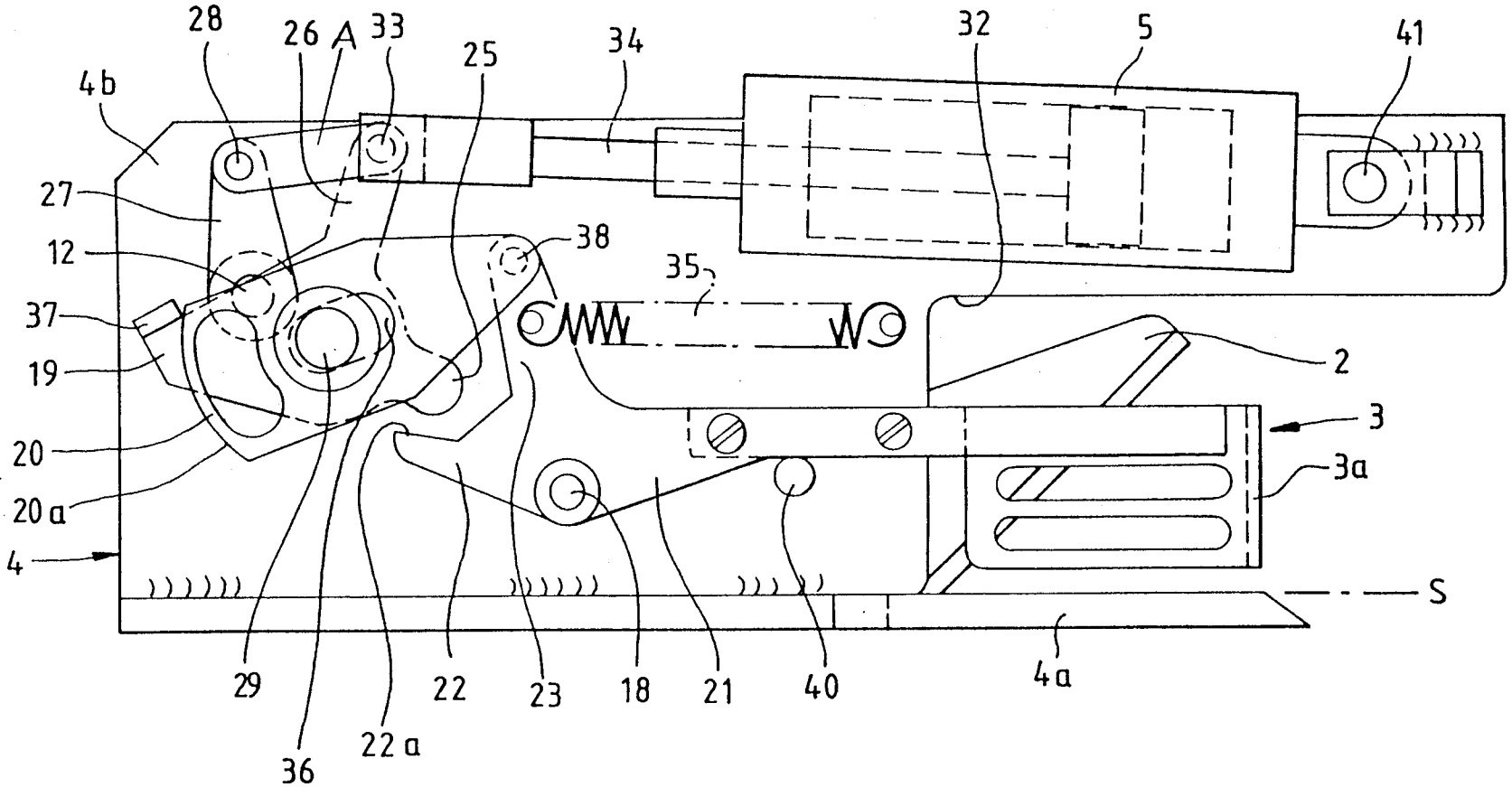
Figure 3:
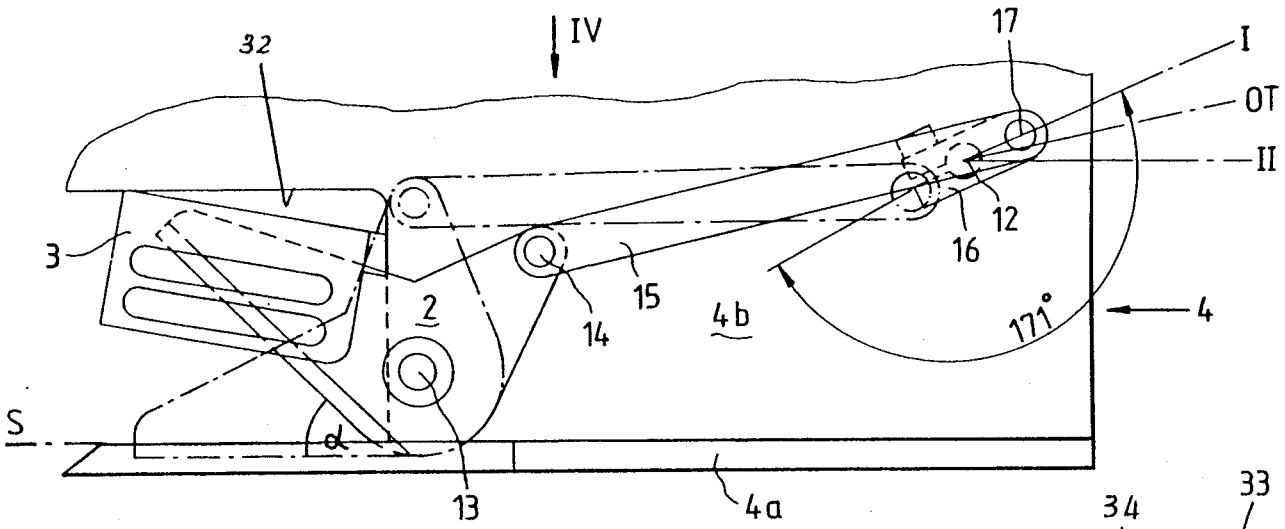
FIG. 3 is a side view of the cutting device, as seen in the direction of arrow III in FIG. 1.

The support 4 includes a base plate 4*a* which extends in the horizontal plane and which defines a cutting plane S (FIGS. 2, 3). It also includes a vertically extending web 4*b* which extends parallel to the cutting direction, the cutting direction being perpendicular to the direction of transport of the material 30 being sewn, and the travel direction being defined as an imaginary line between the needle 9 and the support bar for the presser foot 8.

The cutting device 1 is firmly attached to the work table 31, for instance bolted to it, via the base plate 4*a*. A second knife 39 is arranged, fixed in position, in the base plate 4*a*. The second knife 39 cooperates with the knife 2 so that they cut like a pair of shears. The web 4*b* has a recess 32 which forms a space between the base plate 4*a* and the web 4*b* at a cutting area defined by the knife 2. The knife 2 and the knife guard 3 are guided within this space (FIG. 2).

Figure 4:
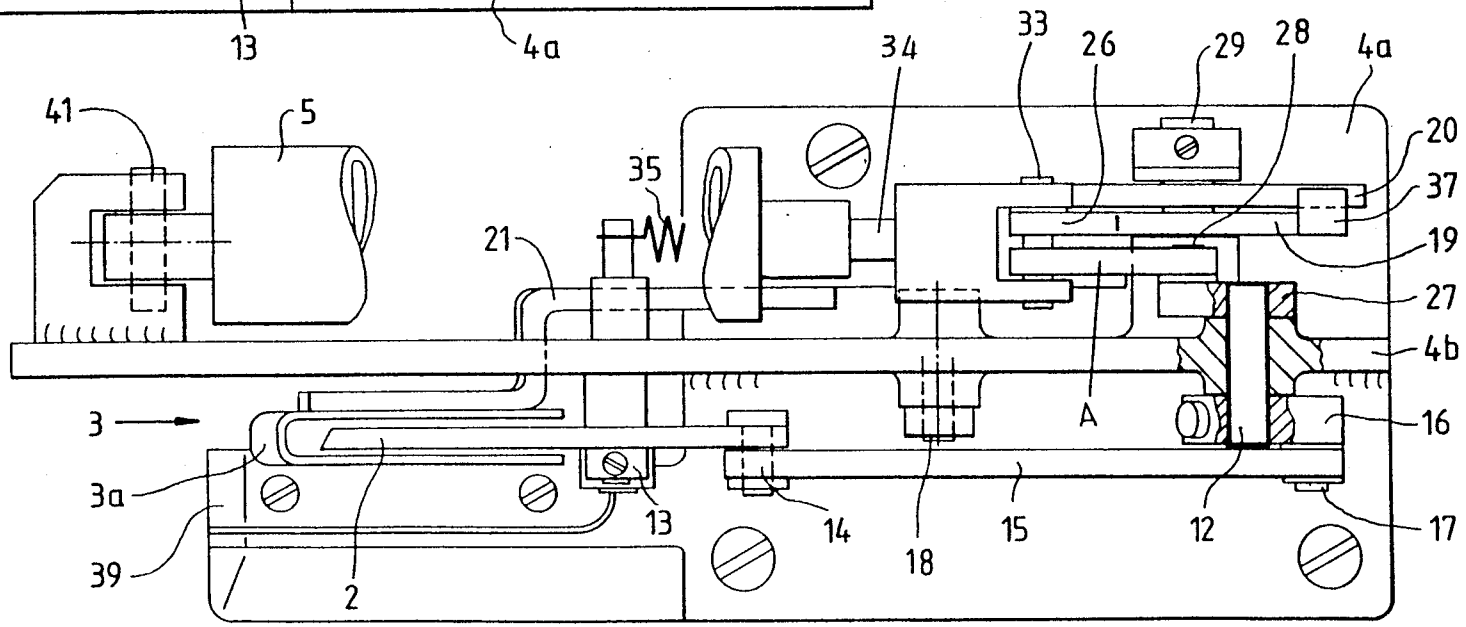
FIG. 4 is a top view of the cutting device, as seen in the direction of arrow IV in FIG. 3.

As best seen in FIGS. 2 and 4, the pneumatic cylinder 5 is pivoted by a horizontal lug 41 on the web 4*b* above the knife 2 and the knife guard 3. The piston rod 34 of the cylinder 5 is connected to a crank 27, to be described further below, and a lever 19.

The boot-shaped knife 2 is swingably mounted on a bolt 13 on the side of the support 4 facing the sewing area 7 and is connected to a connecting rod 15 by a joint 14. The end of the connecting rod 15 away from the knife 2 is, in turn, pivotally connected at a joint 17 to a crank 16 which is arranged fixed in position on a shaft 12 which extends through the support 4.

As shown in FIG. 3, the stationary pivot points formed by the bolt 13 and the shaft 12 are at different heights above the cutting plane S. Specifically, the bolt 13 around which the knife 2 pivots is mounted lower than the shaft 12. The connecting rod 15 transmits, to the knife, the driving movement of the crank 16, which will be explained in further detail below. The upwardly pivoted position of the knife 2, shown as a solid line in the figure, occurs when the crank 16 and the pivot point 17 assume their position furthest away from the bolt 13. The lowermost position of the knife 2, namely the cutting position shown in dot-dash lines, results when the movement of the crank causes the minimum distance between the bolt 13 and the joint 17 to occur. In the embodiment shown, these two knife end positions are determined by a rotation of the crank 16 by about 171°.

The knife 2 is shaped in this embodiment so that, in its cutting position (dot-dash lines), the pivot points of joint 14 and bolt 13 lie in a vertical line. In the raised position, the knife 2 forms an angle $\alpha$ of about 45° with the cutting plane S.

The knife guard 3 (see FIG. 4) comprises a yoke 3*a* which encloses the knife 2 on both sides and is fastened to a lever 21. The lever 21 is angularly bent so that it passes from the yoke 3*a* on its side facing the sewing area 7, through the web 4*b* toward the side facing away from the sewing area 7, and then in a course parallel to the web 4*b*. At its end remote from the yoke 3*a*, the lever 21 is pivotally mounted on a bolt 18 which is rigidly connected to the web 4*b*, so that when the lever 21 pivots around this point, the knife guard 3 moves from an initial upper position into a lower protective position which protects the fingers of the operator. In the upper position, the knife guard 3 forms an angle $\beta$ of about 10° with the cutting place. In the lower position, the lever 21 of the knife guard 3 strikes against a stop 40 provided on the web 4*b*. This stop 40 may be formed by a bolt which is screwed or welded in position, and prevents any hard impact of the yoke 3*a* on the base plate 4*a* of the support 4, which would result in increased wear. On the end of the lever 21 opposite the yoke 3*a*, past the mounting point formed by the bolt 18 (to the left in FIG. 2), two claws 22, 23 are formed on the lever 21 and define an acute angle to each other. A horizontally extending tension spring 35 is fastened to the upper claw 23. The other end of the spring 35 is attached to the web 4*b*. The spring 35 is tensioned in the upwardly swung position of the knife guard 3, whereby the tension spring 35 serves as a drive for the knife guard 3.

In accordance with FIG. 2, aside from the lever 21, two other levers 19 and 20 are mounted on a bolt 29 fastened on the web 4*b*, with the lever 19 being mounted between the web 4*b* and the lever 20. The lever 19 is mounted on the bolt 29 via a bored hole, in a manner not described in further detail here, so that it can carry out only a purely rotational movement. On the other hand, the lever 20 is guided by a slot 36 so that it can carry out a combined rotational and translational movement. The lever 20 is connected to the upper claw 23 of the lever 21, via a joint 38.

The lever 19 has an upward directed claw 26 and a downward directed claw 25, the claws 25, 26 forming an angle of about 90° with each other. The upper claw 26 is connected via joint 33 to the piston rod 34 of the pneumatic cylinder 5. The lower claw 25 cooperates with the guide surface 22*a* of the claw 22 which is formed on the lever 21. At the end thereof remote from the knife guard 3, the lever 19 is provided with a stop 37 which extends over the top of the lever 20 (see FIG. 4).

A crank 27, which is fastened in fixed position on the shaft 12, is connected at pivot points 28, 33 via connecting rod A to the claw 26 of the lever 19. Outward movement of the piston rod 4 of the pneumatic cylinder 5 therefore directly produces a turning movement of the crank 27 and of the crank 16 which is also arranged on the shaft 12, for driving the knife 2 and for rotating the lever 19.

Operation

Starting from the initial position shown in FIG. 2, i.e., with the knife 2 and knife guard 3 swung up, the operation of the cutting device will now be explained, with reference to FIGS. 5 to 7, which are schematic diagrams for explaining the kinematic system of the cutting device. For purposes of clarity, the portion of the connecting rod A between the pivot points 28 and 33 has been shown broken at a point A in FIGS. 5–7.

Figure 5:
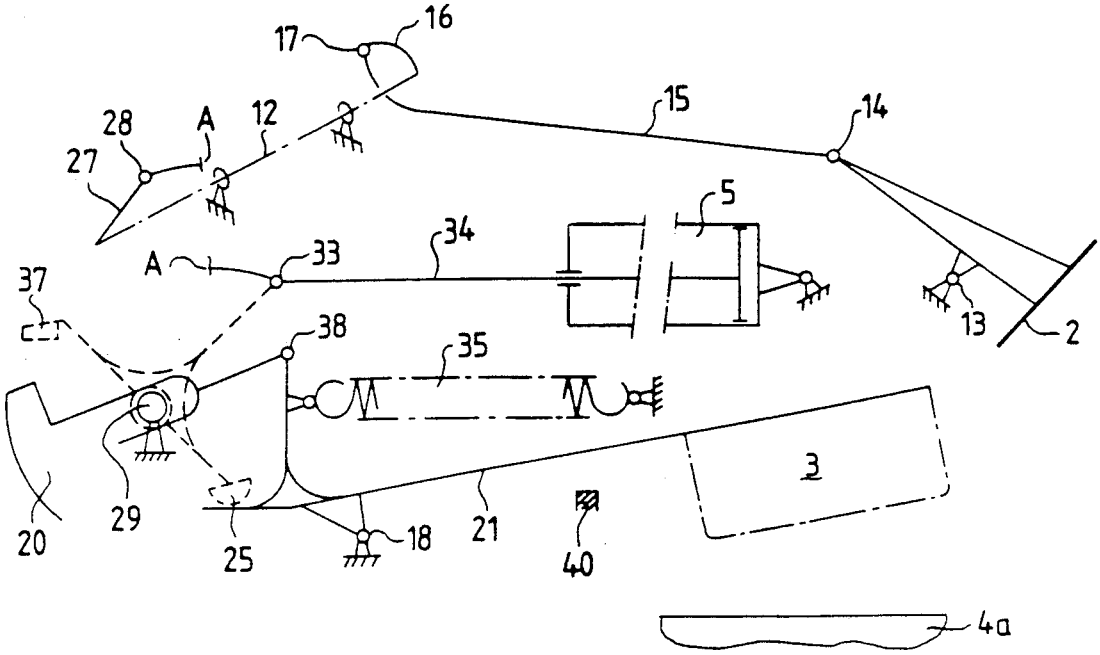
FIG. 5 is a schematic diagram explaining the kinematic system of the cutting device in an initial position of the knife and the knife guard.
Figure 6:
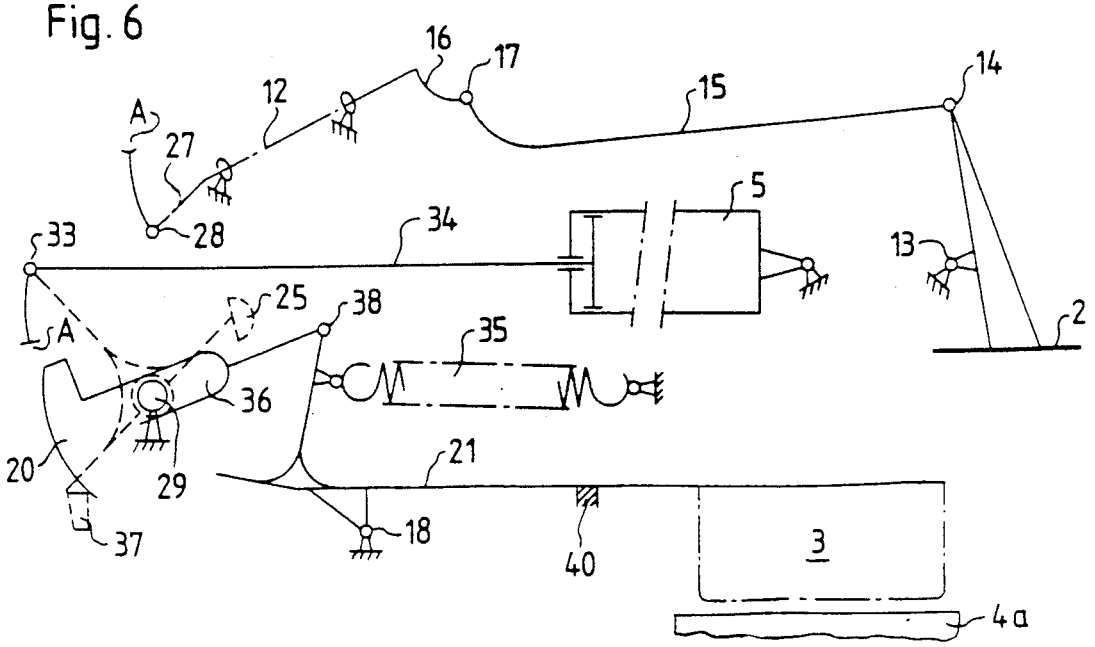
FIG. 6 is a schematic diagram explaining the kinematic system of the cutting device in the cutting position of the knife and the knife guard.

In FIG. 5, the piston rod 34 of the pneumatic cylinder 5 is shown completely retracted. The lever 19 is pulled downward (rotated clockwise in the drawing) via the claw 26 which is pivoted at 33 to the piston rod 34, and the lever 19 presses the claw 22 formed on the lever 21 downward by means of its claw 25, so that the knife guard 3 is swung into its upper position against the force of the tension spring 35, which is thereby tensioned. The crank 27, which is also pivoted to the piston rod 34 at pivot points 28, 33 via the connecting rod A, and drives the knife 2 via the shaft 12 and the crank 16, is pulled into its rearmost position (to the right in the drawing). The crank 16 is arranged offset to the crank 27 on the shaft 12 in such a manner that it is now in the position I shown in FIG. 3, so that the knife 2 is also swung upward. In position I, the crank 16 still has not reached the position of coincidence OT, which it will reach in the following movement of the crank. This is absolutely necessary in this embodiment, because despite the simultaneous drive of knife 2 and knife guard 3, it must be assured that the knife 2 carries out no or practically no downward movement, until the knife guard 3 is in its protective position. The downward directed movement of the knife 2 commences only when the position of coincidence OT has been attained by the crank 16.

Still referring to FIG. 5, the first stage of the lowering of the knife guard will now be described. When the piston rod 34 moves out, the lever 9 and the crank 27 are swung forward (counterclockwise in the drawing). As a result, the claw 25 formed on the lever 19 begins to move upward in a circular path upward (via the counterclockwise rotation) and the lever 21 on which the guard yoke 3*a* is fastened is pulled by the force of the tension spring 35 downward, following an oppositely directed circular path toward the cutting plane, as the claw 25 slides along the guide surface 22*a* formed on the claw 22. This causes a corresponding turning movement of the claw 23 of the lever 21. The claw 23 carries along the lever 20, which slides on the bolt 29, guided by the slot 36, in an elliptical or oval path which results from the rotation of the lever 21 around the point 18, and from the horizontal change in position of the pivot point 38. The knife guard 3 is moved downward by the force of the tension spring 35 and, at the same time, braked by the claw 25 of the lever 19 which still rests in force-locked manner against the claw 22 of the lever 21. In this way, it is assured both that the lowering of the knife guard 3 is controlled by the pneumatic cylinder 5, and that injury to the operator by the knife guard 3 itself is prevented, since the force with which the knife guard contacts the cutting plane S results only from the spring force and from its own weight.

Thus, the knife guard 3 immediately carries out a downward movement when the piston rod 34 moves outward. At the same time, referring now to FIG. 7, the crank 16 is shifted by the shaft 12 and/or the crank 27 in the direction of its position of coincidence OT, so that the knife 2 initially carries out an upward directed swinging movement which only becomes a downward directed movement when the position of coincidence OT has been passed through.

As the piston rod 34 moves further outward (FIG. 7), the knife guard 3 descends further and pulls the lever 20 along with it. The lever 19 is swung in a direction of rotation opposite to this. For reasons of safety it is necessary in this example for the downward movement of the knife 2 to start only after the knife guard has descended practically completely. Otherwise there would be the danger of injury if, for instance, the operator had a finger in the angle formed by the knives 2 and 39 while the piston rod 34 moved outward. To meet this requirement, the lever 20 and the lever 19 are shaped so that the stop 37 arranged on the lever 19, protruding over the lever 20, can travel along the edge 20*a* of the lever 20 when the knife guard 3 has descended to a few millimeters above the cutting place, that is, when the lever 20 has been swung away sufficiently far toward the knife guard 3, by the claw 23 formed on the lever 21. FIG. 7 shows the stop 37 almost passing onto the edge 20*a* of the lever 20.

In its upwardly swung position, the knife 2 is in a substantially steeper position than the knife guard 3. This means that when the crank 16 rotates from the initial position I (FIG. 5) to the point II (FIG. 3) the knife carries out only an extremely slight downward movement, while the knife guard 3 descends practically to the cutting plane S with its lever 21 against the stop 40. In this connection, it is seen that the path the knife 2 carries out for each change in the crank angle depends on the position of the crank 16. If, as in the preferred embodiment shown, the position of coincidence OT lies practically mid-way between point I (basic position) and point II (practically lowered knife guard 3), then the absolute position of the knife 2 has not changed and the angle $\alpha_I$ (the angle $\alpha$ of the knife 2 in crank position I) equals $\alpha_{II}$ (the angle $\alpha$ of the knife 2 in crank position II).

Figure 7:
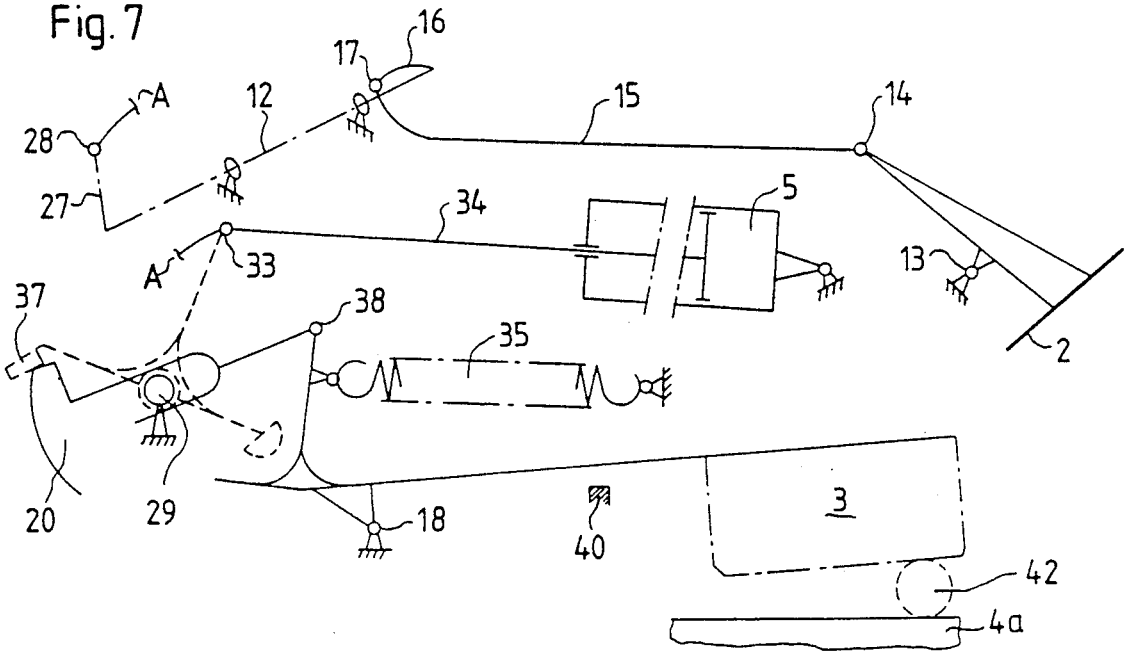
FIG. 7 is a schematic diagram explaining the kinematic system of the cutting device with the knife guard not completely lowered.

Now suppose that the knife guard 3 cannot descend to the cutting plane because, for example, the operator has a finger 42 in between (FIG. 7). In this case, since the lever 21 is loaded only by the force of the spring 35, the lever 20 cannot be shifted further on the shaft 29. The lever 19, which is subjected to a rotary movement by the piston rod 34, strikes via its stop 37 against the lever 20 and thereby prevents further outward movement of the piston rod 34, and as a further result, no further downward movement of the knife 2 is possible. In connection with the arrangement of the levers 20 and 21 on the web 4*b*, it is important in this embodiment for no forces directed toward the cutting area S to be exerted on the lever 21 when the stop is against lever 20, since otherwise there is the danger of the knife guard squeezing the operator's finger 42. For this reason, an imaginary line drawn at the pivot point 38, which is perpendicular to the imaginary line between the center point of the bolt 29 and the joint 38, should pass either through the pivot point 18, or between the pivot point 18 and the yoke 3*a*. In the latter case, the lever 21 is relieved from load when the stop 37 strikes against the lever 20.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A cutting device for a sewing machine, having a cutting area in the vicinity of its sewing area;

the cutting device including a knife and a knife guard which is movable into a protective position surrounding the cutting area; common drive means for driving the knife and the knife guard;

mechanical stop means for stopping the knife, and for releasing the knife only when the knife guard is substantially in its protective position surrounding the cutting area;

wherein the stop means operates automatically during the movement of the knife and the knife guard toward the cutting area, to stop the movement of the knife, if the knife guard is not substantially in its protective position.

2. A cutting device according to claim 1, wherein the drive means drives the knife and the knife guard simultaneously, and starting from an initial position, the knife and the knife guard are initially driven in opposite directions.

3. A cutting device according to claim 1, wherein the drive means commences the movement of the knife guard and the knife towards the cutting area simultaneously; and the knife guard reaches the cutting area before the knife.

4. A cutting device according to claim 3, wherein the knife and the knife guard follow an arcuate path from their initial position, about a pivot point, as they are lowered to a cutting plane spanning the cutting area, and the maximum angle of movement of the knife with respect to the cutting plane is greater than the maximum angle of movement of the knife guard with respect to the cutting plane.

5. A cutting device according to claim 3, wherein the stop means so operates in response both to the degree to which the knife guard has been lowered, and to the drive means which controls the downward movement of the knife.

6. A cutting device according to claim 5, wherein initially the knife is driven by the drive means and the knife guard is simultaneously braked by the drive means when the movement of the knife and knife guard toward the cutting plane begins.

7. A cutting device according to claim 5, wherein the mechanical stop means comprises two levers, the first lever being attached to and driven by the knife guard, and the second lever being driven by the drive means.

8. A cutting device according to claim 7, wherein the first and second levers are mounted for rotation about a common shaft; the first lever carries out a combined rotational and translational movement; and the second lever carries out a purely rotational movement.

9. A cutting device according to claim 8, wherein the second lever has a stop mounted thereon which extends toward the first lever and engages against the first lever so as to prevent further movement of the knife, when the knife guard is not substantially completely lowered.

10. A cutting device according to claim 8, wherein said translational movement of the first lever causes said stop on the second lever to bypass the first lever when said knife guard is substantially completely in its protecting position.

11. A cutting device according to claim 8, wherein the knife guard has first and second claws attached thereto, the first claw being pivotally connected with the first lever, and the second claw engaging the second lever and driving the same.

* * * * *

UNITED STATES PATENT AND TRADEMARK OFFICE

CERTIFICATE OF CORRECTION

PATENT NO. : 5,018,464

DATED : May 28, 1991

INVENTOR(S) : Klaus Hampel; Reinhold Schrudde

It is certified that error appears in the above-identified patent and that said Letters Patent is hereby corrected as shown below:

On the title page item [73]

Change the name of the Assignee from "Kochs Adler Aktiengesellschaft" to --Durkopp Adler AG--.

Signed and Sealed this

First Day of December, 1992

*Attest:*

*Attesting Officer*

DOUGLAS B. COMER

*Acting Commissioner of Patents and Trademarks*